United States Patent [19]

Quay et al.

[11] 4,270,369

[45] Jun. 2, 1981

[54] DEVICE FOR DETECTING BROKEN HEADS OF KNITTING MACHINE NEEDLES

[75] Inventors: Earl R. Quay, Orangeburg, S.C.; Gerhard Jauch, West Lawn, Pa.

[73] Assignee: Mayer, Rothkopf Industries, Inc., Orangeburg, S.C.

[21] Appl. No.: 114,233

[22] Filed: Jan. 22, 1980

[51] Int. Cl.[3] ..... D04B 35/10

[52] U.S. Cl. ..... 66/157

[58] Field of Search ..... 66/157, 163

[56] References Cited

U.S. PATENT DOCUMENTS

| | | | |
|---|---|---|---|
| 2,161,209 | 6/1939 | Vossen | 66/157 |
| 2,481,632 | 9/1949 | Vossen | 66/157 |
| 2,661,615 | 12/1953 | Crawfort et al. | 66/157 |
| 2,963,890 | 12/1960 | Hodt | 66/157 |
| 3,509,739 | 5/1970 | Gottschall | 66/157 |
| 3,690,127 | 9/1972 | Tellerman et al. | 66/157 |

FOREIGN PATENT DOCUMENTS

| | | | |
|---|---|---|---|
| 2654084 | 6/1977 | Fed. Rep. of Germany | 66/157 |

*Primary Examiner*—Ronald Feldbaum

*Attorney, Agent, or Firm*—Frailey & Ratner

[57] ABSTRACT

Device for a knitting machine operative to detect knitting needles having broken heads and to actuate a stop motion to shut down the machine. The device includes a needle sensing unit connected electrically to the stop motion and having a retractable sensor element for sensing broken needles, and a needle deflecting roller for deflecting unbroken needles away from the needle sensor element. An adjustable support bracket mounts the needle sensing unit and needle deflecting roller on a knitting machine to locate the needle deflecting roller in the needle path to contact the hooks of unbroken needles and to locate the needle sensor element in the needle path to contact the stems of broken needles. Needles having broken heads are not deflected by the needle deflecting roller, but are sensed by the needle sensing unit to activate the stop motion.

11 Claims, 1 Drawing Figure

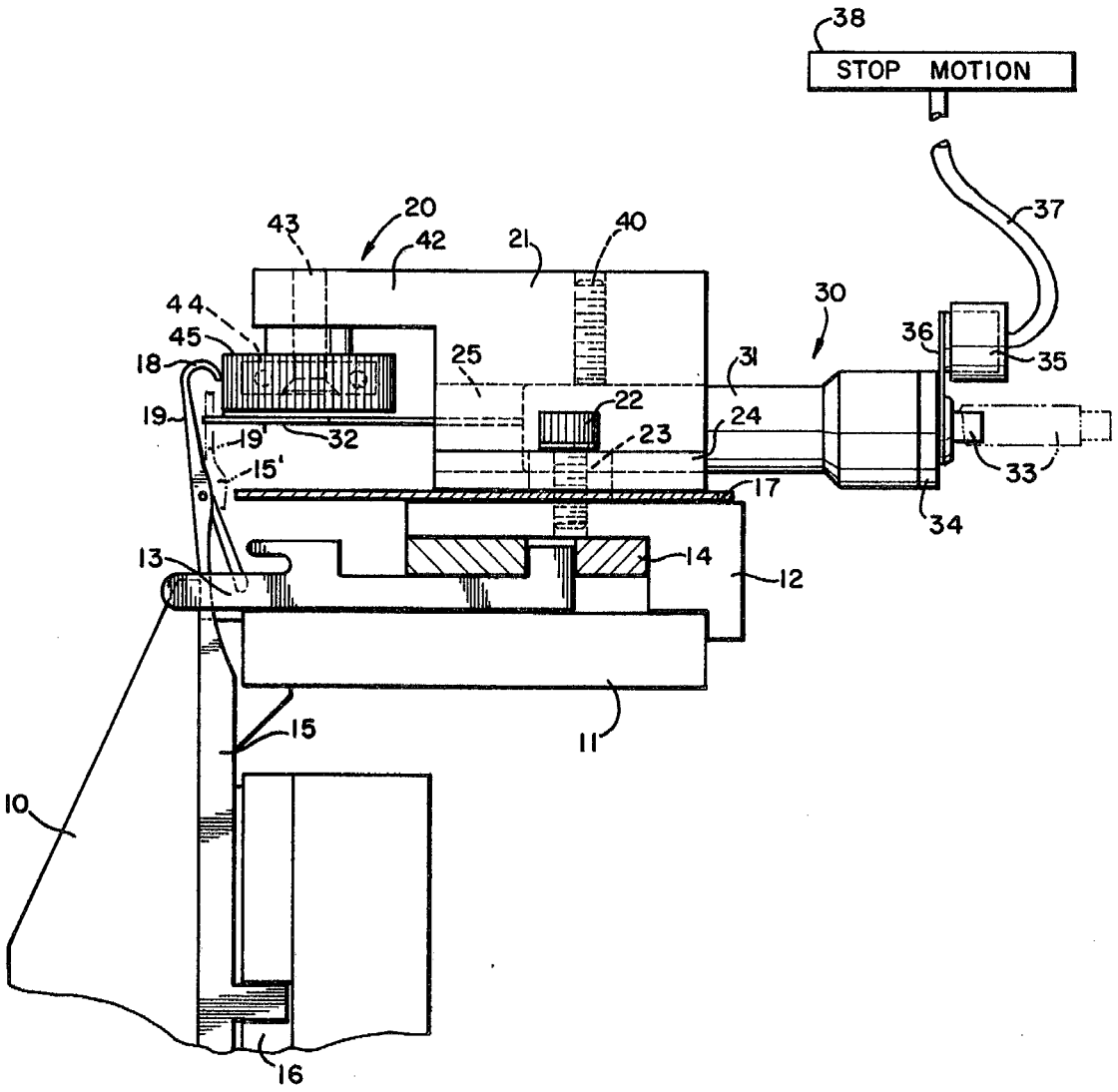
STOP MOTION
38
37
35
36
33
34
30
31
24
17
12
14
23
22
40
21
25
20
42
43
32
44
45
18
19
19'
15'
13
15
16
11
10

DEVICE FOR DETECTING BROKEN HEADS OF KNITTING MACHINE NEEDLES

BACKGROUND OF THE INVENTION

This invention pertains to the field of weft knitting machines utilizing independent needles. It is directed to a new and useful device for reliably sensing needles having broken heads and then quickly shutting down the operation of such machines. During the operation of weft knitting machines, the needles are subject to substantial stresses as a result of which they may be broken or otherwise damaged. When this occurs, faults occur in the fabric which is in the process of being knit by the needles. Occasionally, machine damage also occurs. The knitting of sliver high pile fabrics on conventional open top circular knitting machines is particularly hard on the needles. Broken needle heads frequently occur as the result of needle stresses encountered in that type of knitting.

Various types of faulty or broken needle detection devices have been known to and used in the art. None, however, have combined the advantages of simplicity, economy of manufacture, reliability in use and immediacy of operation in the detection of broken needles and the shutting down of the knitting machine. This is particularly true in respect to sliver knitting, where fly loss and the unusual stresses imposed on the knitting needles present several problems. Electronic, photoelectric and magnetic broken or faulty needle detection devices have been utilized, but all of them have proven to be highly expensive and of doubtful reliability. Magnetic needle detection devices also suffer from a tendency toward oversensitivity, whereas photoelectric needle detection devices have proven to be generally unsatisfactory in sliver high pile knitting due to the interference of the fly with the light beam.

SUMMARY OF THE INVENTION

The primary object of this invention is to overcome the faults and shortcomings of broken needle detecting devices of the type heretofore utilized, and to provide a new, improved, useful and economical broken needle detection device which is particularly advantageous in the knitting of sliver high pile fabrics.

A further object of the invention is to provide a new and improved device for detecting broken heads of knitting machine needles which is simple of construction, reliable in operation and economical of manufacture and which functions quickly to shut down a knitting machine upon the breaking of a needle head.

A further object of the invention is to provide a device for detecting broken heads of knitting machine needles which includes needle deflecting means and broken needle sensing means, both of which are adapted to be located in the needle path of the knitting machine, and wherein the needle deflecting means is operative to deflect unbroken needles only to ensure that they are not sensed by the broken needle sensing means.

A further object of the invention is to provide a broken needle detection device having a retractable broken needle sensing finger disposed in the path of the needles as they travel relative to the knitting machine, and a needle deflecting roller, also disposed in the needle path, adapted to deflect unbroken needles away from the broken needle sensing finger, thereby ensuring that the sensing finger senses broken needles only and is operative to shut down immediately the knitting machine when this occurs.

Other objects and advantages of this invention will be seen from the following description of the preferred embodiment of this invention in conjunction with the drawing referred to herein.

DESCRIPTION OF THE DRAWING

The drawing is a fragmentary, partially diagrammatic, view in side elevation of an open top circular independent needle knitting machine incorporating the preferred embodiment of the invention.

DESCRIPTION OF THE PREFERRED EMBODIMENT OF THE INVENTION

Referring to the drawing, the invention is shown as applied to an open top circular independent needle knitting machine. The machine includes a needle cylinder 10, sinker dial 11, sinker cap 12, sinkers 13, sinker cams 14, needles 15, needle or knitting cams 16 and needle latch guard 17. The needles 15 are provided with heads constituted of their hooks 18 and stems 19 formed below the hooks. The machine is of the type generally illustrated in U.S. Pat. Nos. 1,114,414, 3,010,297, 3,299,672 and 3,427,829 especially designed for knitting sliver high pile fabric. However, it is to be understood that the invention is applicable to any type of weft knitting machine utilizing independent needles, including open top machines for knitting jersey fabric, dial and cylinder machines for knitting rib fabrics, circular knitting machines have either rotatable or stationary needle cylinders, V-bed machines, etc.

Affixed to the top of the sinker cap 12 is the preferred embodiment of the broken needle detecting device 20 of this invention. The device 20 includes a radially disposed support bracket 21 firmly secured to the sinker cap 12 by means of a pair of arcuately spaced bolts 22 which extend through narrow slots 23 formed in radially disposed lips or flanges 24 extending along the spaced bottom edges of the bracket 21. The slots 23 together with the bolts 22 constitute adjustable mounting means for the bracket 21, which permit the bracket to be mounted selectively on the sinker cap 12 at selected incremental radial positions relative to the needles 15.

The bracket 21 is provided with an internal, axially extending bore 25 for the snug reception of the outer cylindrical periphery of the housing 31 of a broken needle sensing unit 30 of the type illustrated in U.S. Pat. No. 2,481,632. The broken needle sensing unit 30 includes a retractable needle sensor finger or element 32 operative to be advanced toward the needles 15, into the fixed path followed by the needles as they travel relative to the knitting cams 16. Element 32 is operative to be retracted from the needles when its distal end contacts the stem 19' of a needle 15' having a broken head. The needle sensing unit 30 also includes the usual retractable plunger 33, apertured insulation cap 34 and electric terminal 35 mounted on the distal end of a radially extending arm 36. Wiring 37 connects the terminal 35 to a conventional knitting machine stop motion illustrated diagrammatically at 38. A set screw 40 secures the unit 30 firmly within the bore 25 of bracket 21.

Bracket 21 is provided with an integral arm 42 extending radially inward toward the path of the needles 15. Affixed in the distal end of the arm 42 is a vertical stud shaft 43 extending downwardly relative to, and terminating proximate to, the path of the needles 15.

Secured to the distal end of the vertically depending shaft 43 is a ball bearing 44 on which is mounted a serrated, rotatable needle deflecting roller or wheel 45. As will be observed, the serrated periphery of the needle deflecting roller 45 is located or suspended in the path of the needles 15 in such manner as to permit the roller to contact the hooks 18 of the unbroken needles 15 and deflect the head portions of the needles radially inward of the circle of needles a slight distance. The amount of deflection of a needle head inward of the needle circle is sufficient to permit the unbroken needle to avoid contact with the distal end of the broken needle sensor finger 32 of the needle sensing unit 30. The serrated periphery of the needle deflecting roller 45 facilitates the rotation of the roller by the needles as the needles contact and advance relative to the roller. Rotation of the needle deflecting roller 45 about its axis, as a result of the movement of the needles 15 relative thereto, minimizes strain on the unbroken needles as the result of their deflection.

Needles, such as needle 15', which have a broken head and therefore lack a hook 18, do not contact and are not deflected radially inward by the needle deflecting roller 45. Thus, the stem 19' of a broken needle 15' will contact the sensor finger 32, i.e. is sensed by that element, to activate the needle sensing unit 30 which, in turn, actuates the knitting machine stop motion 38 to shut down the machine, as in the manner taught in U.S. Pat. No. 2,481,632, aforesaid. Thus, the broken needle detecting device 20 of this invention is operative to sense only needles 15' having broken heads and, further, is operative, upon sensing such a broken needle, to immediately activate the stop motion device 38 of the machine.

In practice, one or more of the detecting devices 20 may be utilized on a multi-feed knitting machine, although usually one device is sufficient even for machines having a large number of feeds. The device 20 may be mounted anywhere on the machine in proximity to the path of its needles, but it is preferred that the device be located in an area where the latches of the needles are open. When used on an open top circular knitting machine of the type illustrated in the drawing, a preferred location for the device 20 is at a position where the needles are at tuck level.

The adjustable mounting means for the bracket 21, constituted by the bolts 22 and the slots 23, permits precise adjustment of the device 20 relative to the needles, so as to carefully locate the serrated needle deflecting roller 45 and the distal end of the retractable needle sensor finger 32, when in its advanced position, in the path of the needles to ensure minimum deflection of the heads of the unbroken needles while ensuring that the broken stems 19' of the needles 15' contact finger 32 to actuate unit 30.

The device 20 of this invention is particularly useful with the sliver high pile fabric circular knitting machines referred to above. Such machines are especially hard on their needles, and broken needle heads are a frequent occurrence due to the strain imposed on them as they pass through, and rake sliver fibers from, the doffers utilized in such machines.

Although a preferred embodiment of this inventin has been shown and described for the purpose of illustration, as required by Title 35 U.S.C. 112, it is to be understood that various changes and modifications may be made therein without departing from the spirit and utility of this invention, or from the scope thereof as set forth in the appended claims.

We claim:

1. A device for detecting broken knitting machine needles during operation of the knitting machine, comprising (a) needle sensing means having a retractable needle sensor element adapted to contact the needles when said sensor is in advanced position, (b) a bracket for supporting the needle sensing means on a knitting machine proximate the needles, (c) needle deflecting means mounted on the bracket for deflecting unbroken needles away from the needle sensor element and (d) mounting means for mounting the bracket on a knitting machine to locate the needle deflecting means and the needle sensor element, when said element is in its advanced position, to contact the needles during machine operation, whereby broken needles not deflected by the needle deflecting means are sensed by the needle sensing means.

2. The device of claim 1, wherein the needle deflecting means comprises a roller.

3. The device of claim 1, wherein the needle deflecting means comprises a roller mounted rotatably on a shaft affixed to the bracket.

4. The device of either claim 2 or claim 3, wherein the needle deflecting roller is serrated.

5. The device of claim 1, wherein each needle has a hook and a stem below its hook and wherein (a) the needle deflecting means is located to contact the hooks of unbroken needles and (b) the needle sensor element, when in its advanced position, is located to contact the stems of broken needles.

6. A broken needle detecting device for a knitting machine having an electric stop motion, knitting cams and a plurality of independent knitting needles which travel along a fixed path relative to the cams during operation of the knitting machine, said device comprising (a) needle sensing means connected electrically to the stop motion and having a retractable needle sensor element adapted to contact the needles when said sensor is in advanced position, (b) a bracket for supporting the needle sensing means on a knitting machine adjacent the needles, (c) needle deflecting means mounted on the bracket for deflecting unbroken needles away from the needle sensor element and (d) adjustable mounting means for selectively mounting the bracket on a knitting machine to locate the needle deflecting means and the needle sensor element, when said element is in its advanced position, in the needle path, whereby broken needles not deflected by the needle deflecting means are sensed by the needle sensing means to activate the stop motion.

7. The device of claim 6, further including (a) an arm extending from the bracket in the direction of the needle path, (b) a shaft affixed to the arm and extending into proximity with the needle path and (c) a rotatable needle deflecting roller mounted on the shaft.

8. The device of claim 7, wherein (a) the shaft has a proximal end affixed to the bracket arm and a distal end on which is affixed a bearing and (b) the rotatable needle deflecting roller is affixed to the bearing.

9. The device of either claim 7 or claim 8, wherein each needle has a hook and a stem below its hook and wherein (a) the needle deflecting roller is located in the needle path to contact the hooks of unbroken needles and (b) the needle sensor element, when in its advanced position, is located in the neeedle path to contact the stems of broken needles.

10. A device for detecting broken heads of knitting machine needles for a knitting machine having an electric stop motion, knitting cams and a plurality of independent knitting needles which travel along a fixed path relative to the cams during operation of the machine, each needle including a hook and a stem below its hook, said device comprising (a) needle sensing means connected electrically to the stop motion and having a retractable needle sensor element adapted to contact the needles when said sensor is in advanced position, (b) a bracket for supporting the needle sensing means on a knitting machine adjacent the needle path, (c) a serrated rotatable needle deflecting roller mounted on the bracket for deflecting unbroken needles away from the needle sensor element and (d) mounting means for selectively mounting the bracket on a knitting machine to locate the needle deflecting roller in the needle path to contact the hooks of unbroken needles and to locate the needle sensor element, when said element is in its advanced position, in the needle path to contact the stems of broken needles during machine operation, whereby needles having broken needle heads are not deflected by the needle deflecting roller and are sensed by the needle sensing means to activate the stop motion.

11. A method for detecting broken knitting machine needles during operation of the knitting machine, comprising:

(a) advancing a plurality of needles along a fixed path relative to a plurality of knitting cams for actuating the needles;

(b) locating a sensor element for sensing broken needles in the needle path at a location to contact the stems of broken needles;

(c) locating a needle deflecting element in the needle path at a location to contact the hooks of unbroken needles and deflect the unbroken needles out of the needle path, whereby the unbroken needles do not contact the needle sensor element, and (d) stopping the knitting machine whenever a broken needle contacts the needle sensor element.

* * * * *